US005319814A

United States Patent [19]

Dyer, Jr.

[11] Patent Number: 5,319,814

[45] Date of Patent: Jun. 14, 1994

[54] BEDDING STRUCTURE WITH ENHANCED POSTURAL SUPPORT

[76] Inventor: Charles D. Dyer, Jr., 11024 Watterson, Dallas, Tex. 75228

[21] Appl. No.: 958,295

[22] Filed: Oct. 7, 1992

[51] Int. Cl.[5] ..... A47C 27/05; A47C 27/16; A47C 27/15

[52] U.S. Cl. ..... 5/464; 5/470; 5/475; 5/481; 5/901

[58] Field of Search ..... 5/470, 464, 901, 475, 5/478

[56] References Cited

U.S. PATENT DOCUMENTS

| | | | |
|---|---|---|---|
| 3,197,357 | 7/1965 | Schulpen | 5/481 |
| 4,187,566 | 2/1980 | Peterson | 5/474 |
| 4,768,251 | 9/1988 | Baskent | 5/464 |
| 4,809,375 | 3/1989 | Bull | 5/470 |
| 4,955,095 | 9/1990 | Gerrick | 5/470 |
| 4,999,868 | 3/1991 | Kraft | 5/464 |
| 5,109,559 | 5/1992 | West | 5/470 |

*Primary Examiner*—Alexander Grosz
*Attorney, Agent, or Firm*—Robert Groover

[57] ABSTRACT

A bedding structure, including an innerspring mattress and a padded cover (enclosing the mattress) which provides added postural support (as well as extra thermal insulation and padding). The padded cover includes a sheet of convoluted foam which covers essentially the full length of the mattress. This sheet of convoluted foam is stiffened, over the middle part of the mattress length, by a complementary piece of convoluted foam which is mated with it. The increase in thickness caused by having two pieces of convoluted foam face-to-face is relatively small. Thus, this arrangement provides extra firmness under the torso, while maintaining an essentially flat upper surface. This cover structure can be retrofitted to existing innerspring mattresses.

31 Claims, 3 Drawing Sheets

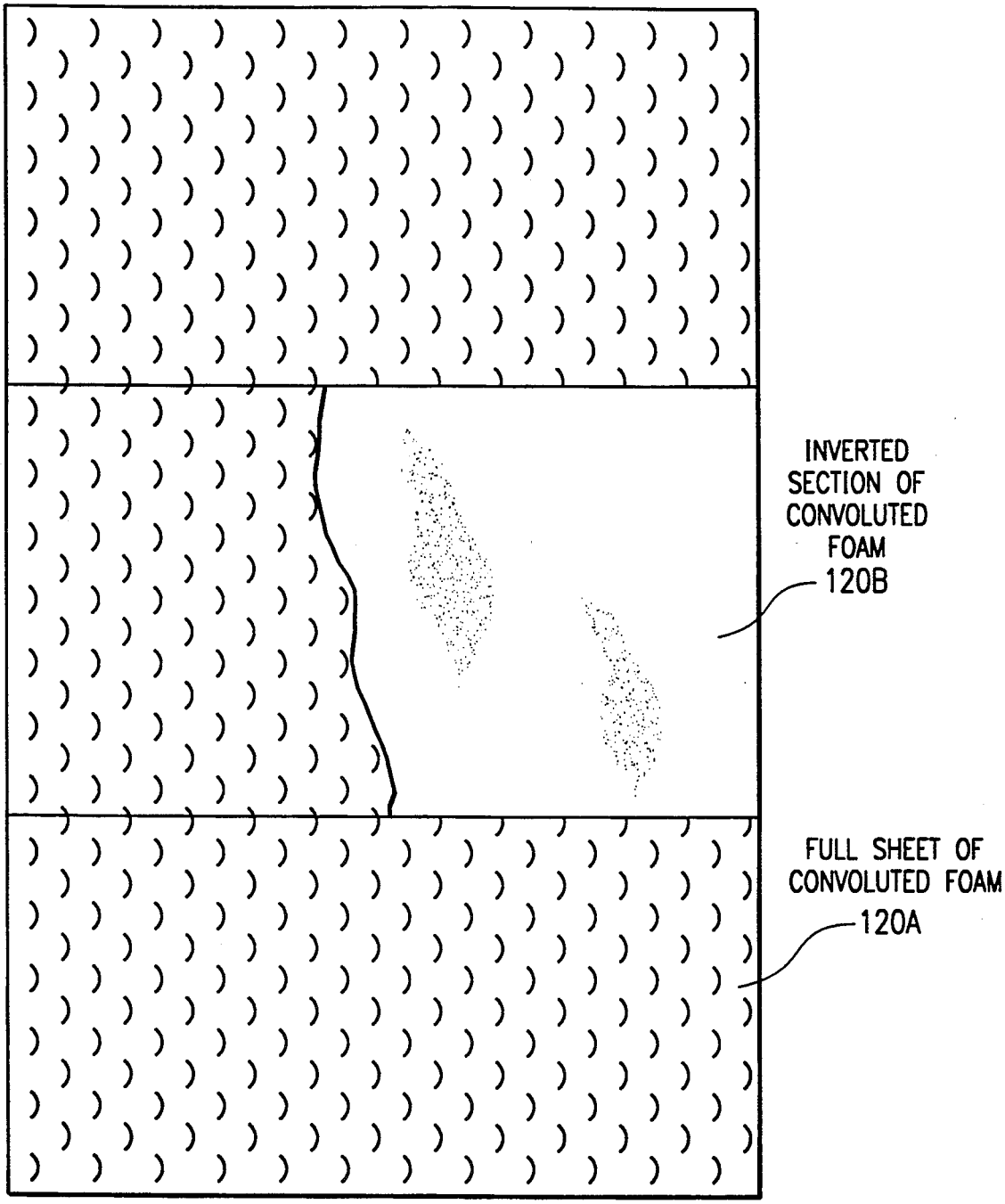
FIG. 2
FIG. 3
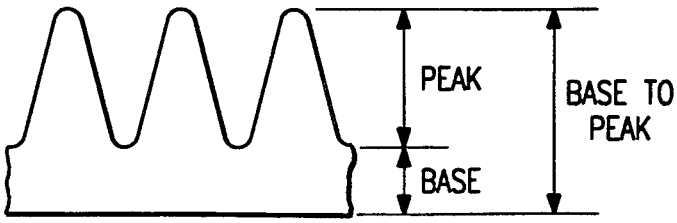

BEDDING STRUCTURE WITH ENHANCED POSTURAL SUPPORT

BACKGROUND AND SUMMARY OF THE INVENTION

The present invention relates to bedding, and particularly to combinations of an innerspring mattress with a quilted mattress cover.

An immense expenditure is laid out for mattresses each year. Some of this expenditure goes for air, water, or foam mattresses, but (in the United States at least) the overwhelming majority of expenditure goes for innerspring mattresses.

Some mattress technologies provide support which is inherently somewhat uniform (e.g. waterbeds, as extensively discussed in the presently preferred embodiment). This is NOT true of innerspring mattresses, where different coils can be made of different stiffnesses, to modulate the hardness of the mattress as desired across the length and width of the mattress. However, many existing innerspring mattresses were manufactured without such modulation, or without an adequate amount of such support modulation.

An innerspring mattress is a moderately expensive and long-lived consumer asset. (A typical price for a good-quality mattress and box-spring set, in the United States, would be in excess of $500, and the in-service lifetime of such a set would typically be more than 10 years.) Thus, purchase of complete bedding sets for all beds in a household would typically be a sizable expenditure. Consumers will be reluctant to replace old mattresses which are still serviceable.

One advantageous application of the disclosed innovations is that they can be used to retrofit improved postural support to an existing innerspring mattress.

A further related advantage of the disclosed innovations is that manufacturers can use these innovative teachings to rapidly modify existing mattress designs, which are already in production (or even in inventory), to improve the postural support at minimal cost.

A further advantage is that a mattress's postural support can be readily customized. Thus, for example, the distribution of support needed by a muscular male athlete is quite different from that needed by a fashionably thin nulliparous adult female, or an obese middle-aged person. By use of the disclosed innovations, customized versions can readily be produced, at minimal cost, as simple modifications to an existing production line.

The hardness of an innerspring mattress is affected by the gauge of the spring wire, the number of springs, and the coil design. There is no generally accepted quantitative measure of hardness or softness of innersprings, but the extreme cases can be readily identified. Thus, for example, a full-size mattress with 312 coils[1] of 12.5 gauge spring wire in Bonnell wrap would be an unusually hard mattress. Mattresses with lighter-gauge spring wire, for a given number of coils, would be softer. For a given spring wire gauge, mattresses with a lower number of coils will generally be softer.

[1] The number of coils is usually specified with reference to the full-size mattress. For a given mattress model, this number is varied proportionately for other mattress sizes.

Harder innerspring mattresses provide better overall postural alignment. However, harder mattresses are more likely to create pressure points. The disclosed innovations provide a way to reconcile these choices, and to obtain the comfort benefits of a soft mattress and also the postural advantages of a hard mattress.

Uniform support presents a problem, because the weight distribution of the human body is not at all uniform. The highest concentration of mass (per unit length in the height axis) will be between the shoulder blades and the hips. The mass per unit length is generally lower at the head, and is much lower in the legs.[2] Thus, if a soft mattress has a uniform thickness and support, the user's hips or buttocks will tend to sink excessively far into the mattress.[3] This problem is exacerbated when the mattress is used by two persons sleeping together.

[2] The weight distribution is, of course, different from person to person, depending on the person's age, height, sex, obesity, and general body type. However, the problems discussed are problems for a very large fraction of users.

[3] Spinal alignment, in a good sleeping posture, should be the same as that in a good standing posture. Thus, a sleeper should be supported so that his or her spine will be laterally straight, and will be curved with no more (and no less) than normal lumbar and thoracic arch and pelvic tilt. Distortions of this sleeping posture will produce immediate or gradual discomfort, and may not be optimal for the sleeper's health.

This deficit in support will tend to reduce the user's comfort, to a greater or lesser degree depending on the user. However, a more important effect is that this deficit in support may permit a user to sleep in a condition of postural misalignment. This may lead to backaches, or to vague discomforts which reduce the user's overall level of health and well-being.

Some efforts have been made to increase the support under the torso.[4] Apart from the art of waterbeds, other attempts have been made to design sleeping pads with some allowance for the uneven weight distribution of the human body. Many of these attempts have used convoluted foam,[5] which is one of the basic structural materials used in designing bedding structures.

[4] For example, the "System 750" waterbed, from Land and Sky, includes a floating foam/fiber structure, inside the bag, which is thicker under the user's midsection to provide additional back support.

U.S. Pat. No. 5,077,848 (to McDaniel et al.) discloses an immersed tube structure, with foam inserts in the tube.

The "Avanti III" model, from Pleasant Rest, is a waterbed with a foam topping, which includes extra layers of fiber (under a single sheet of foam) under the user's midsection to provide added lumbar support.

The "Marvelous Middle" from Restonic includes stiffer springs in the middle of the mattress. The cover itself includes extra lines of stitching, under the sleeper's midsection, which give the impression that the middle of the cover is different from the rest of the cover; but in fact (insofar as is known to the present inventor) the cover is uniform over its length, and does NOT include any additional material under the sleeper's midsection.

[5] Convoluted foam (in which one surface is carved into a rippled or egg-carton shape) is effectively softer than a solid block of foam of equivalent height, because the individual protrusions in the carved portion have more room to expand laterally under pressure. Convoluted foam is described, for instance, in U.S. Pat. No. 3,026,544 to Persicke et al., which is hereby incorporated by reference.

Some of the attempts to use convoluted foam pads for sleeping structures are shown in U.S. Pat. No. 4,620,337 to Williams et al.; 4,955,096 to Gilroy et al.; and 4,879,776 to Farley; all of which are hereby incorporated by reference.

INNOVATIVE BEDDING STRUCTURE

The present invention provides an improved bedding structure, in which added postural support is provided by a padded cover atop the bag (which also provides extra thermal insulation and padding).

The padded cover includes a sheet of convoluted foam which covers essentially the full length of the mattress. This sheet of convoluted foam is stiffened, over the middle part of the mattress length, by a complementary piece of convoluted foam which is mated with it. The increase in thickness caused by having two pieces of convoluted foam face-to-face is relatively small. Thus, this arrangement provides extra firmness under the torso, while maintaining an essentially flat upper surface.

Preferably the convoluted foam structure is glued to (or quilted into, or otherwise integrated into) the mattress cover. This helps to provide stability in use. However, in markets where absolute minimum cost is essential, it is also alternatively possible to simply let the pressure of the cover, and the weight of the sleep atop it, hold the foam pads in place.

Optionally the cover may be constructed to be easily removable. (For example, in the presently preferred embodiment the top of the cover is attached to the bottom of the cover by a zipper around the full periphery of the cover.) Thus, the mattress cover can be removed for cleaning, or the mattress material can easily be replaced if desired, or the mattress and cover can be separated for storage or moving. However, this feature is most attractive for use with retrofits; for new manufacture a non-removable cover would often be used instead.

In the sample described embodiment, this cover structure is demonstrated on a soft-sided waterbed. However, the disclosed innovations can be applied to a wide variety of bedding structures. In particular, air mattresses, and mattresses made entirely of polymer foam, can be made more comfortable and healthy by use of the disclosed innovations.

In another sample embodiment, this cover structure is demonstrated on an innerspring mattress. Preferably the cover structure provides enhanced postural support, as described above, on both upper and lower surfaces of the mattress. This permits users to readily turn over a mattress, without worrying about which side has the enhanced support.

BRIEF DESCRIPTION OF THE DRAWING

The present invention will be described with reference to the accompanying drawings, which show important sample embodiments of the invention and which are incorporated in the specification hereof by reference, wherein:

FIG. 2 is a bottom view (with partial cutaway) of the two-piece support structure, using two pieces of convoluted foam, of the presently preferred embodiment.

FIG. 3 is a schematic detail view of the shape and typical dimensions of a sample convoluted foam structure.

DESCRIPTION OF THE PREFERRED EMBODIMENTS

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

FIG. 3 is a schematic detail view of the shape and typical dimensions of a sample convoluted foam structure. The foam actually used, in the presently preferred embodiment, is an open-cell foam of polyurethane composition, of about 1 pound per cubic foot bulk density. The "ILD" parameter (indentation load deflection) is about 30, in the presently preferred embodiment. The convoluted shape used has a base thickness of ½", and an overall height of 1½". (Thus, when two pieces of foam are mated together, their overall thickness is only 2 inches.)

Figure 1:
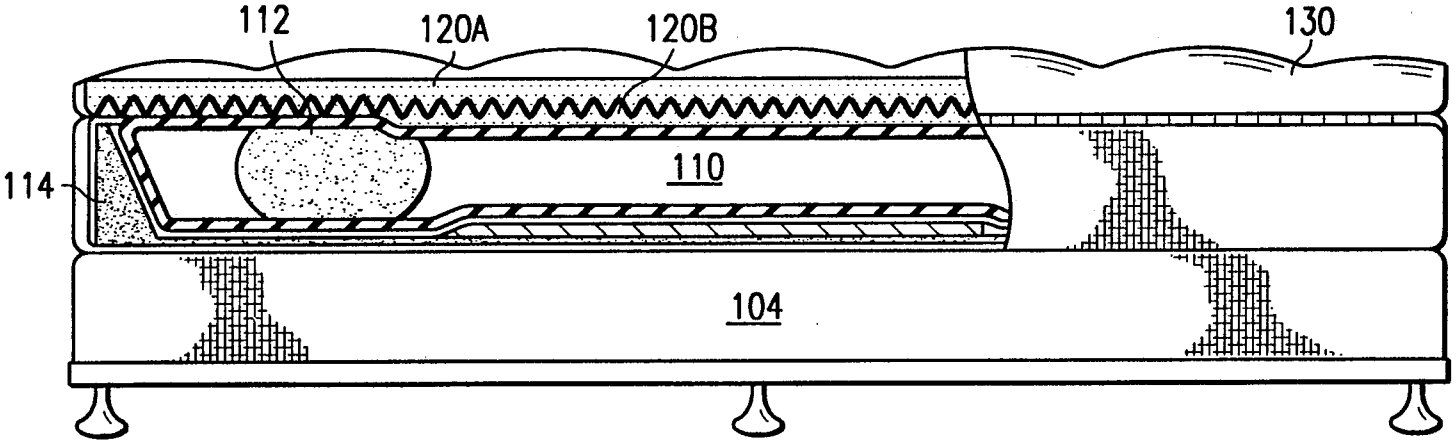
FIG. 1 is a sectional view of the waterbed mattress structure of the presently preferred embodiment.

FIG. 1 is a sectional view of the waterbed structure of the presently preferred embodiment. A foundation 104 supports the mattress structure at a conventional height. Bag 110 is filled with water, and also (in this sample embodiment) contains fibrous material 112 for dampening wave motion. Bag 110 is dimensioned to a standard mattress size, e.g. queen size or king size. Bag 110, in the presently preferred embodiment, is made of virgin vinyl, 18–24 mils (0.018–0.024") thick (20 mils in the presently preferred embodiment).

Bag 110 is laterally surrounded by a sidewall support structure 114, made of higher-density flexible foam. In the presently preferred embodiment, this sidewall support structure has a density of 1.5 ppcf, and an ILD of 65.

Foam padding 120A and 120B lies atop the bag 110. Foam piece 120A extends over the full width and length of the filled bag, and lies with its points down. Foam piece 120B covers the full width of the bag, but covers only the middle third (approximately) of the length of the bag. Foam piece 120B lies with its points up, so that pieces 120A and 120B are mated together over the entire area of piece 120B.

A polypropylene-damask cover 130 holds the foam padding 120 in place, and also includes additional top padding for comfort.[6] This cover is shaped as a complete zip-on enclosure, in the presently preferred embodiment; but alternatively the cover could be configured as a separable two-piece structure if desired. The foam pads 120 are glued to the cover 130, in the presently preferred embodiment, but alternatively they could be quilted to it, attached in other ways, or simply be emplaced loose to be retained by the pressure of the cover.

[6]Of course, the cover can alternatively include other materials, such as wool batting, knit, chintz, or other fabric.

FIG. 2 is a bottom view (with partial cutaway) of the two-piece support structure, using two pieces of convoluted foam, of the presently preferred embodiment.

Sleepers of different heights will typically align themselves to the head end of the mattress, and the following sample dimensions take account of this. However, of course, these dimensions can be made symmetrical (so that head-foot reversal will not affect them), or otherwise altered in a variety of ways.

For example, for a king-size mattress, the dimensions of the elements described above, in the presently preferred embodiment, are: top foam padding piece 120A: 76" wide by 80" long; bottom foam padding piece 120B: 68" wide by 26" long.

Thus, the unsupported length of top piece 120A at the head end is 23 inches, and the unsupported length of top piece 120A at the foot end is 31 inches.

Figure 4:
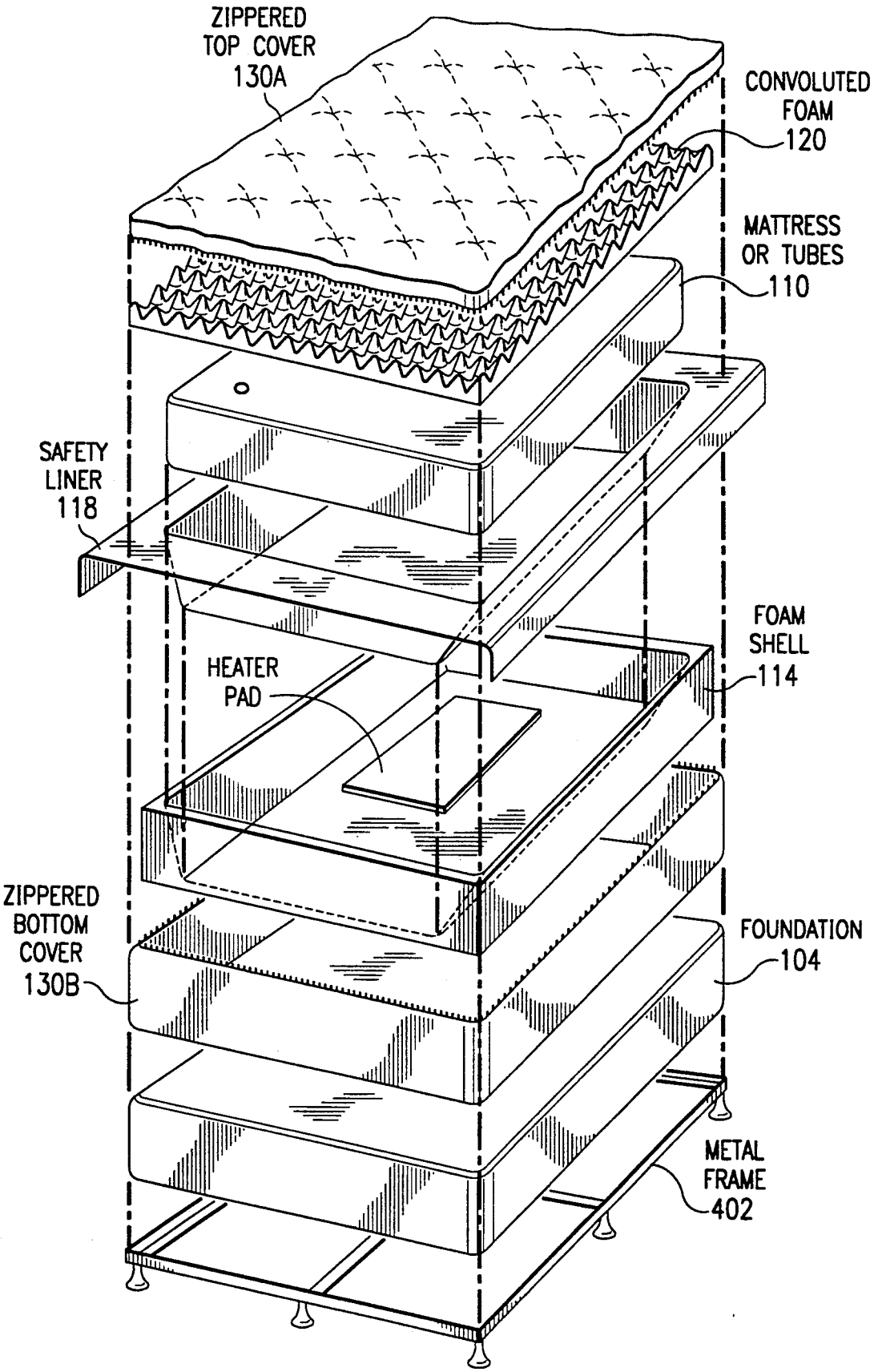
FIG. 4 is an exploded view of a sample soft-sided waterbed structure, showing the complete context in which the structure of FIG. 1 is used, in a sample embodiment.

FIG. 4 is an exploded view of a sample soft-sided waterbed structure, showing the context in which the structure of FIG. 1 is used, in a sample embodiment.

A heavy duty metal frame 402 rests on the floor, and supports a foundation 104. The foundation 104, in the presently preferred embodiment, is simply a wood-framed structure, with a quilted cover on it, which provides a flat top surface strong enough to support the weight of the waterbed mattress.

The cover 130 includes a top portion 130A and a bottom portion 130B, which are zipped together by a horizontal circumferential zipper 132. The cover 130 encloses the sidewall support structure 114. (Note that the sidewall support structure includes a bottom portion, extending the full width of the bed, to resist the spreading forces due to the lateral pressure of the bag.) A heater 116 (optional), a liner 118, and the bag 110, all lie within the well of support structure 114.

Foam padding 120, made of a two-layer structure as shown in FIGS. 1 and 2 (but not in FIG. 4), lies atop the bag 110, and is enclosed by cover 130.

Of course, the specific structure of FIG. 4 is not strictly necessary for the practice of the invention.

Innerspring Embodiment

Figure 5:
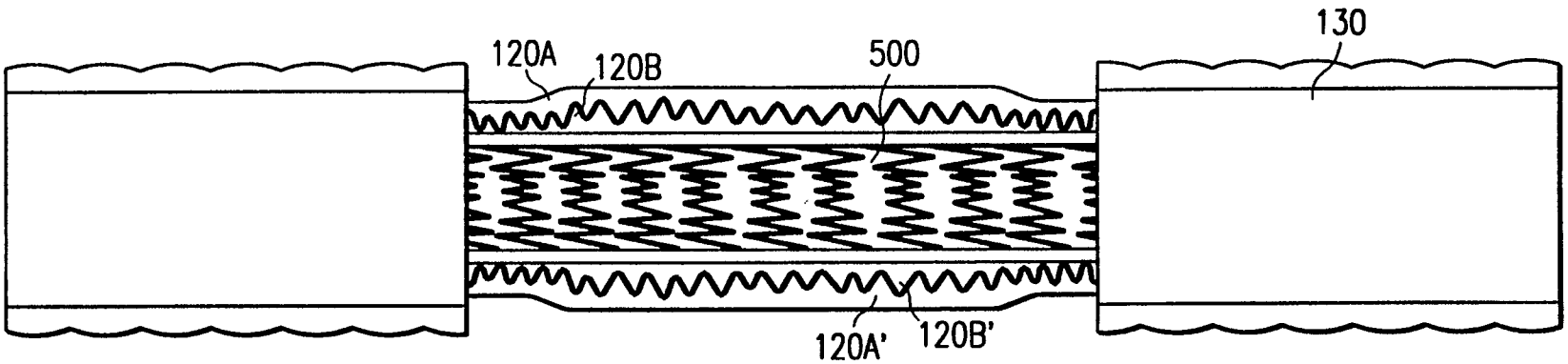
FIG. 5 is a cutaway view of a sample embodiment of an inner-spring mattress enclosed in a cover which has enhanced postural support on both upper and lower surfaces of the mattress.

FIG. 5 is a cutaway view of a sample embodiment of an inner-spring mattress enclosed in a cover which has enhanced postural support on both upper and lower surfaces of the mattress. The innerspring mattress 500 is enclosed within a cover 130. This cover holds two foam pieces 120A and 120B in place on top of the mattress, as described above. This cover also holds two additional two foam pieces 120A' and 120B' in place on the bottom side of the mattress. This permits users to use either side of the mattress, and to readily turn it over.

Further Modifications and Variations

It will be recognized by those skilled in the art that the innovative concepts disclosed in the present application can be applied in a wide variety of contexts. Moreover, the preferred implementation can be modified in a tremendous variety of ways. Accordingly, it should be understood that the modifications and variations suggested below and above are merely illustrative. These examples may help to show some of the scope of the inventive concepts, but those examples do not nearly exhaust the full scope of variations in the disclosed novel concepts.

For example, although the presently preferred embodiment uses soft-sided bed structure, the disclosed innovations can also, alternatively and less preferably, be adapted to a hard-sided structure.

For another example: the convoluted foam is in an egg-carton pattern, in the presently preferred embodiment. However, a ripple pattern, or another self-complementary pattern, or a pair of different but complementary patterns, could alternatively be used instead.

Of course, the dimensions and material compositions of the presently preferred embodiment have been specified merely for full compliance with the best mode requirements, and can be widely modified and varied.

One contemplated class of alternative embodiments provides an insert for hardside waterbeds, which incorporates enhanced postural support as described above.

As will be recognized by those skilled in the art, the innovative concepts described in the present application can be modified and varied over a tremendous range of applications, and accordingly the scope of patented subject matter is not limited by any of the specific exemplary teachings given.

What is claimed is:

1. A bedding structure, comprising:

a mattress, having a substantially rectangular top surface of substantially predetermined width and length;

a first polymer foam pad, having at least one convoluted surface, and having one horizontal dimension at least equal to 80% of said predetermined width, and having another horizontal dimension at least equal to 80% of said predetermined length;

a second polymer foam pad, having at least one convoluted surface, and having one horizontal dimension at least equal to 65% of said predetermined width, and having another horizontal dimension substantially less than 70% of said predetermined length;

said first and second foam pads being mated together with respective convoluted surfaces thereof facing together, and positioned atop said mattress;

a cover holding said pads in place atop said mattress.

2. The bedding structure of claim 1, wherein said mattress is an innerspring mattress.

3. The bedding structure of claim 1, wherein said mattress is an innerspring mattress, and includes at least two coil springs of different respective stiffnesses.

4. The bedding structure of claim 1, wherein said mattress is an innerspring mattress, and includes fewer than 15 coil springs per square foot of top surface.

5. The bedding structure of claim 1, wherein said mattress is an innerspring mattress, and includes fewer than 28 coil springs per square foot of top surface.

6. The bedding structure of claim 1, wherein said mattress is an innerspring mattress, and includes multiple coil springs which each have a minimum wire gauge of 13 gauge or thinner.

7. The bedding structure of claim 1, wherein said mattress is an innerspring mattress, and includes multiple coil springs which each have a minimum wire gauge of 12½ gauge or thinner, and also includes wire supporting structures, connected to said springs, which are thicker than 16 gauge.

8. The bedding structure of claim 1, wherein said convoluted surface of said first foam pad and said convoluted surface of said second foam pad are both convoluted with the same pattern.

9. The bedding structure of claim 1, wherein said convoluted surface of said first foam pad and said convoluted surface of said second foam pad are both convoluted with an egg-carton pattern.

10. The bedding structure of claim 1, wherein said first and second foam pads are upholstered into said cover, and are concealed from view, and are not directly in contact with said mattress.

11. The bedding structure of claim 1, wherein said first and second foam pads are glued to said cover, and lie directly atop said mattress.

12. The bedding structure of claim 1, wherein said predetermined width and length correspond to a queen size bed.

13. The bedding structure of claim 1, wherein said first foam pad consists essentially of a polymer foam having an ILD measurement of at least 25.

14. The bedding structure of claim 1, wherein said cover is removably fastened atop said mattress.

15. The bedding structure of claim 1, wherein said cover also retains third and fourth foam pads, which are similar to said first and second foam pads respectively, on the underside of said mattress opposite to said first and second foam pads.

16. A mattress cover bedding structure, for assembly to a mattress having a substantially predetermined width and length, comprising:

a first foam pad having at least one convoluted surface, and having a width approximately equal to at least 80% of said predetermined width, and having a length approximately equal to at least 80% of said predetermined length;

a second foam pad, having at least one convoluted surface, and having a width approximately equal to at least 70% of said width of said first foam pad, and having a length less than 70% of said length of said first foam pad, said second foam pad being overlaid by said first pad;

a cover, fastenable atop the mattress to hold said first and second foam pads thereon;

said cover and said first and second foam pads being mechanically connected together in a common flexible structure.

17. The bedding structure of claim 16, wherein said convoluted surface of said first foam pad and said convoluted surface of said second foam pad are both convoluted with the same pattern.

18. The bedding structure of claim 16, wherein said convoluted surface of said first foam pad and said convoluted surface of said second foam pad are both convoluted with an egg-carton pattern.

19. The bedding structure of claim 16, wherein said cover and said first and second foam pads are glued together.

20. The bedding structure of claim 16, wherein said cover and said first and second foam pads are quilted together.

21. The bedding structure of claim 16, wherein said cover includes upper and lower portions and a zipper therebetween.

22. The bedding structure of claim 16, wherein said cover includes upper and lower portions, and a zipper which extends around the circumference of said upper and lower portions.

23. The bedding structure of claim 16, wherein said first and second foam pads are upholstered into said cover, and are concealed from view, and are not directly in contact with said mattress.

24. The bedding structure of claim 16, wherein said predetermined width and length correspond to a queen size bed.

25. The bedding structure of claim 16, wherein said cover is removably fastenable around the mattress.

26. The bedding structure of claim 16, wherein said cover also retains third and fourth foam pads, which are similar to said first and second foam pads respectively, on the underside of said mattress opposite to said first and second foam pads.

27. A bedding structure, comprising:

a mattress, having a substantially rectangular top surface of substantially predetermined width and length;

a first foam pad having at least one convoluted surface, and having a width approximately equal to at least 80% of said predetermined width, and having a length approximately equal to at least 80% of said predetermined length;

a second foam pad, having at least one convoluted surface, and having a width approximately equal to at least 80% of said width of said first foam pad, and having a length less than 70% of said length of said first foam pad;

means for retaining said first and second foam pads in an overlaid relation atop said mattress;

wherein said retaining means is readily detachable, to permit rapid removal of said foam pads from atop said mattress.

28. The bedding structure of claim 27, wherein said convoluted surface of said first foam pad and said convoluted surface of said second foam pad are both convoluted with the same pattern.

29. The bedding structure of claim 27, wherein said retaining means also retains third and fourth foam pads, which are similar to said first and second foam pads respectively, on the underside of said mattress opposite to said first and second foam pads.

30. The bedding structure of claim 27, wherein said convoluted surface of said first foam pad and said convoluted surface of said second foam pad are both convoluted with an egg-carton pattern.

31. The bedding structure of claim 27, wherein said first and second foam pads are upholstered into said cover, and are concealed from view, and are not directly in contact with said mattress.

* * * * *